US006092341A

United States Patent [19]

Yamashita et al.

[11] Patent Number: 6,092,341

[45] Date of Patent: Jul. 25, 2000

[54] CONCRETE CYLINDRICAL BODY WITH ASEISMIC BASE ISOLATION STRUCTURE, METHOD FOR MANUFACTURING THE SAME AND LAMINATED RING ASSEMBLY THEREFOR

[75] Inventors: Akishi Yamashita; Isao Aoki, both of Toyama, Japan

[73] Assignee: Akishi Yamashita, Toyama, Japan

[21] Appl. No.: 09/154,719

[22] Filed: Sep. 17, 1998

[30] Foreign Application Priority Data

Feb. 6, 1998 [JP] Japan ..... 10-025615

[51] Int. Cl.[7] ..... E04H 9/02

[52] U.S. Cl. ..... 52/167.1; 52/167.4; 52/167.8; 52/736.1; 52/745.17; 267/148; 267/167

[58] Field of Search ..... 52/167.1, 167.4, 52/167.2, 167.7, 167.8, 167.9, 736.1, 742.1, 745.17; 14/73.5; 267/148, 167, 204

[56] References Cited

U.S. PATENT DOCUMENTS

| | | | |
|---|---|---|---|
| 3,503,635 | 3/1970 | Cheatwood et al. | 285/133.5 X |
| 4,150,475 | 4/1979 | Bondpers et al. | 29/469 |
| 4,533,109 | 8/1985 | Delam | 52/167.1 X |
| 4,633,628 | 1/1987 | Mostaghel | 52/167.7 |
| 4,786,341 | 11/1988 | Kobatake et al. | 52/167.1 X |
| 5,016,409 | 5/1991 | Sato | 52/167.2 |
| 5,669,189 | 9/1997 | Logiadis et al. | 52/167.9 X |
| 5,678,809 | 10/1997 | Nakagawa et al. | 267/148 |

FOREIGN PATENT DOCUMENTS

| | | | |
|---|---|---|---|
| 4-89979 | 3/1992 | Japan | 52/167.7 |
| 1423717 | 9/1988 | Russian Federation | 52/167.7 |

*Primary Examiner*—Carl D. Friedman
*Assistant Examiner*—Winnie Yip
*Attorney, Agent, or Firm*—McDermott, Will & Emery

[57] ABSTRACT

A concrete rod-like member having a seismic control structure which utilizes structural features of the rod-like structure efficiently without paying high cost and is capable of protecting a body potion of the rod-like member (including a building carried on piles when the rod-like member is used as the piles) against rupture even when subjected to the level 2 load. A piled ring assembly composed of a plurality of annular plates placed one upon another and tied together in a direction of piling is disposed around the periphery of a longitudinal portion of a body of the concrete rod-like member such that a central axis of the piled ring assembly is coincident with a longitudinal central axis of the rod-like member body. The longitudinal portion of the rod-like member body including the ring assembly forms a frail portion of the rod-like member. The rod-like member may include two or more of the frail portion.

15 Claims, 5 Drawing Sheets

CONCRETE CYLINDRICAL BODY WITH ASEISMIC BASE ISOLATION STRUCTURE, METHOD FOR MANUFACTURING THE SAME AND LAMINATED RING ASSEMBLY THEREFOR

BACKGROUND OF THE INVENTION

1. Field of the Invention

The present invention relates to a concrete rod-like member having a seismic control structure for protecting concrete rod-like structures, such as piles, poles, towers or chimneys, placed vertically or substantially vertically in or on the earth, and buildings and constructions carried on the piles from natural disasters such as earthquakes. It also relates to a method of manufacturing such concrete rod-like structure, and a piled ring assembly used therein.

2. Prior Art

Conventionally, except for those used in nuclear facilities, for example, concrete rod-like members, such as piles, poles, towers or chimneys, placed in or on the earth are generally designed to withstand a vibrational external force (hereinafter referred to as "level 1 load") which may be probably caused by earthquakes or winds once or twice during the service life of a structure in which the concrete rod-like members are used. For the structure using such concrete rod-like members, however, the social circumstances have recently changed such that a vibrational external force (hereinafter referred to as "level 2 load") which is much less in probability of occurrence during the service life but is much greater in strength than the level 1 load, such as experienced in Hanshin-Awaji Earthquake Disaster, must not be disregarded.

Taking this into consideration, a design concept recently taken in many structures is to utilize high-strength materials or members having large cross-sectional areas to increase the design level 1 load to enhance the earthquake-proof strength of the structures. Such design concept, however, tends to pay too much cost for the least possible situation.

SUMMARY OF THE INVENTION

In view of the foregoing, an object of the present invention is to provide a concrete rod-like member having a seismic control structure which utilizes structural features of the rod-like member efficiently without requiring high cost and thus can protect a main structural part of the rod-like member (including a building or the like construction carried on piles when the rod-like member is used as the piles) to the maximum extent against rupture or failure when subjected to the level 2 load.

To attain the foregoing object, a seismic control structure of the concrete rod-like member according to the present invention is designed to have an earthquake-proofing strength (anti-seismic strength) large enough to withstand the conventional level 1 load. Additionally, the seismic control structure includes a frail portion formed as a discrete longitudinal portion of the concrete rod-like member. When the concrete rod-like member is subjected to a level 2 shearing load acting in a direction perpendicular to a longitudinal axis of the rod-like member, the frail portion absorbs the level 2 load before a linear distortion caused under the level 1 load grows up to cause rupture Thus, a body of the rod-like member can be protected against rupture as far as possible. When the concrete rod-lime member is used as piles placed in the ground, the frail portion greatly suppresses transmission of the level 2 load to a building or the like construction carried on the piles.

The frail portion is formed by a piled ring assembly disposed around the periphery of a longitudinal portion of the rod-like member body such that a central axis of the ring assembly is coincident with a longitudinal central axis of the rod-like member. The ring assembly is composed of a plurality of annular plates placed one upon another and tied together to such an extent that the annular plates do not separate from one another. When subjected to the level 2 shearing load, the piled ring assembly undergoes interlayer distortion or displacement to thereby absorb unexpected loads and energies. The piled ring assembly may be formed by a helically coiled plate having successive convolutions tied together in a direction parallel to a central axis of the coiled plate.

In one aspect the present invention provides a concrete rod-like member having a seismic control structure, comprising: a rod-like member body; and a piled ring assembly composed of a plurality of annular plates placed one upon another and tied together in a direction of piling, the piled ring assembly being disposed around the periphery of a longitudinal portion of the rod-like member body in such a manner that a central axis of the piled ring assembly is coincident with a longitudinal central axis of the rod-like member body, the piled ring assembly forming a frail portion In another aspect the present invention provides a concrete rod-like member having a seismic control structure, comprising: a rod-like member body; and a piled ring assembly comprised of a helically coiled plate having successive convolutions tied together in a direction parallel to a central axis of the coiled plate, the piled ring assembly being disposed around the periphery of a longitudinal portion of the rod-like member body in such a manner that a central axis of the piled ring assembly is coincident with a longitudinal central axis of the rod-like member body, the piled ring assembly forming a frail portion.

In still another aspect the present invention provides a method of manufacturing a concrete rod-like member having a seismic control structure, comprising the steps in the order named of: forming a cylindrical cage-like frame which serves as a reinforcing core of a body of the concrete rod-like member to be manufactured, the cylindrical cage-like frame having a length corresponding to the length of the concrete rod-like member body, setting around the periphery of a longitudinal portion of the cylindrical cage-like frame, a piled ring assembly composed of a plurality of annular plates placed one upon another and tied together in a direction of piling, or a piled ring assembly comprised of a helically coiled plate having successive convolutions tied together in a direction parallel to a central axis of the coiled plate; placing the cylindrical cage-like frame and the piled ring assembly assembled thereon into one of two form halves of a split form prepared for casting the concrete rod-like member, the form halves having a semicircular cross-sectional shape; placing the other form half over the cylindrical c;age-like frame to close the form; tightly fastening together the two form halves; casing fluid concrete into the form; after the casing completes, placing the form horizontally over a rotating roller support table; activating the rotating roller support table to rotate the form about its longitudinal axis at speeds increasing gradually to cause the fluid concrete to be forcibly displaced against an inner wall of the form by the action of a centrifugal force, thereby forming a concrete rod-like member body having an internal longitudinal hollow portion; steam-curing the fluid concrete inside the form to set the form of the concrete rod-like member body; and removing the form to thereby obtain a concrete rod-like member.

In another aspect the present invention provides a piled ring assembly for use in the manufacture of a concrete rod-like member body so as to form a frail portion along the periphery of a longitudinal portion of the concrete rod-like member body, wherein fluid concrete is cast in c form which accommodates within it a cylindrical cage-like frame serving as a reinforcing core of the concrete, and the pile ring assembly mounted around the periphery of a longitudinal portion of the cylindrical cage-like frame, and wherein the piled ring assembly comprises: a plurality of annular plates placed one upon another and tied together in a direction of piling, or a helically coiled plate having successive convolutions tied together in a direction parallel to a central axis of the coiled plate.

BRIEF DESCRIPTION OF THE DRAWINGS

The above objects and features of the present invention will be apparent from the following description of preferred embodiments of the present invention given below with reference to the accompanying drawings, in which.

DETAILED DESCRIPTION OF THE PREFERRED EMBODIMENTS

Figure 1A:
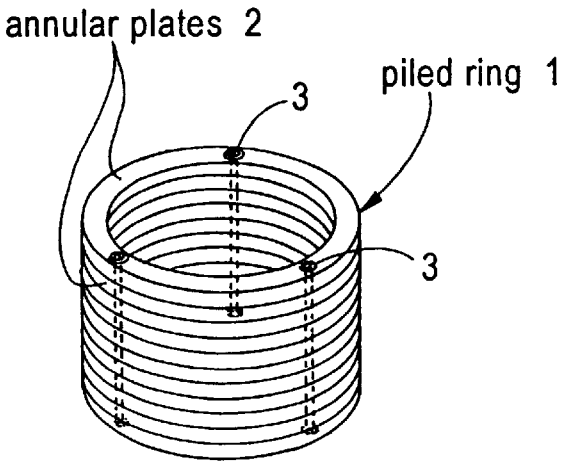
FIG. 1A is a perspective view showing one example of a piled ring assembly consisting of annular plates used in a preferred embodiment of a concrete rod-like member having a seismic control structure according to the present invention.

Certain preferred embodiments of the present invention will be described below in greater detail with reference to FIGS. 1 through 9. FIG. 1A shows a piled ring assembly 1 which serves as a seismic control device according to the present invention. The piled ring assembly I is composed of several to several tens of annular plates 2 of identical circular ring-like configurations that are placed one upon another and tied together in a direction of piling by a plurality of binding or fastening members 3 at portions spaced at equal intervals in the circumferential direction of the annular plates 2 (each of the annular plates 2 has a contact surface so treated with a coating of various lubricants as to have a coefficient of friction which is theoretically determined by the relationship between the surcharge and level 2 load and the shearing strength of a concrete rod-like member). The binding members 3 may include threaded fasteners such as bolts and nuts, and steel wires. When the steel wires are used, they are caulked at opposite ends to tie or bind the annular plates 2 to such an extent that the piled ring assembly 1 is kept from disassembling or separating apart.

The piled ring assembly 1 is incorporated in a concrete rod-like member in order to form a seismic control structure. A method of manufacturing the concrete rod-like member will be described below with reference to FIGS. 2 through 8.

Figure 2:
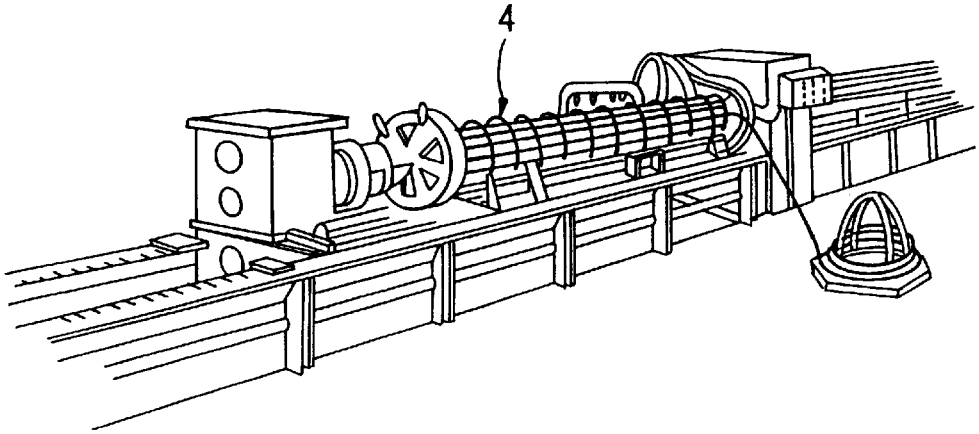
FIG. 2 is a schematic perspective view showing a wire binding process to form a cylindrical cage-like frame in the manufacture of a concrete rod-like member according to the present invention.

At first, a plurality of main or longitudinal reinforcing bars arranged at equal angular intervals along a circle, and a spiral hoop of steel wire wound around the longitudinal reinforcing bars are assembled or otherwise bound together to form a generally cylindrical cage-like frame 4, as shown in FIG. 2. The cage-like frame 4 thus formed constitutes a reinforcing core of a concrete rod-like member, as will be understood later. Additionally, the cylindrical cage-like frame 4 has an outside diameter smaller than the inside diameter of the piled ring assembly 1.

Figure 3:
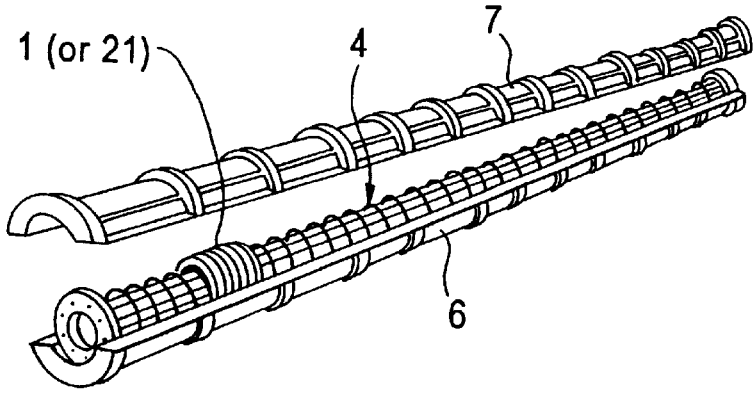
FIG. 3 is a schematic perspective view showing a form assembling process in the manufacture of the concrete rod-like member.

Then, using a split cylindrical form 5 constructed by two form halves 6, 7 of semicircular cross section for casting a desired concrete rod-like member, the cylindrical cage-like frame 4 is put into one form half 6. In this instance, the cage-like frame 4 has on its outer peripheral portion the piled ring assembly 1 previously mounted along a longitudinal portion of the cage-like frame 4 which corresponds in position to a portion of the concrete rod-like member to be constructed to have a seismic control function, as shown in FIG. 3. Subsequently, the other form half 7 is placed over the cage-like frame 4 and after that respective flanges of the frame halves 6, 7 are tightly fastened together by bolts (not shown) to construct the cylindrical form 5.

Figure 4:
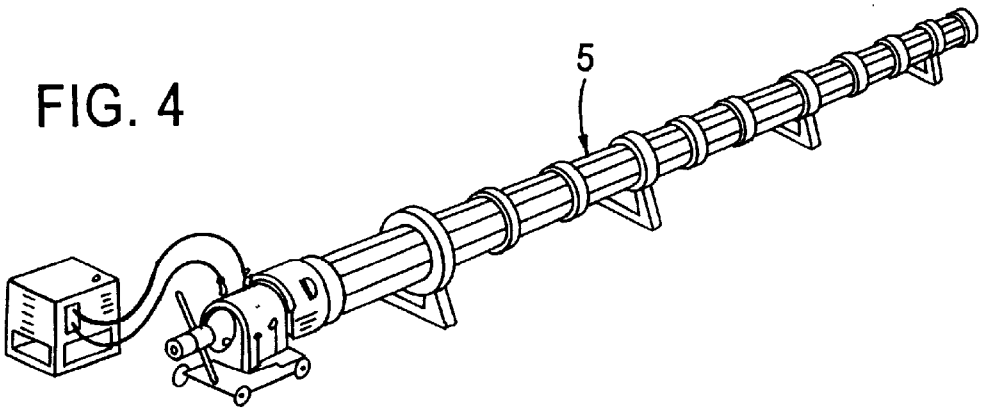
FIG. 4 is a schematic perspective view showing a wire tensioning process in the manufacture of the concrete rod-like member.
Figure 5:
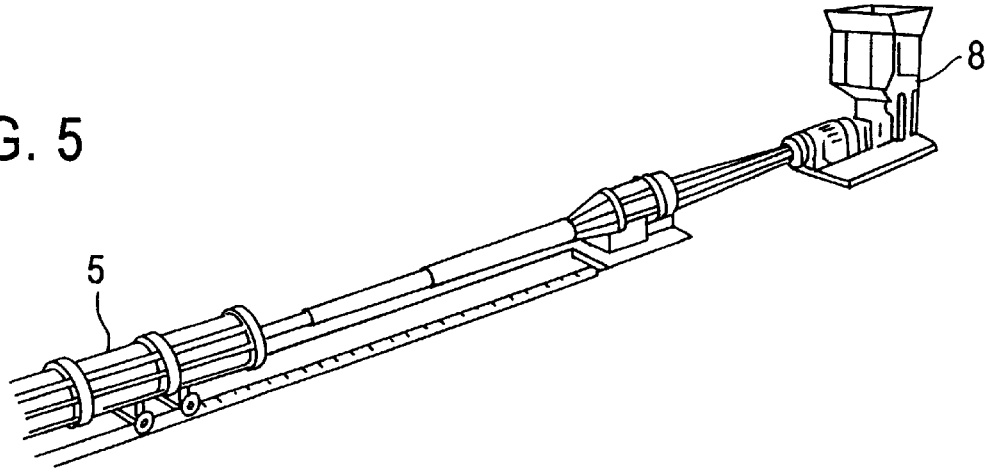
FIG. 5 is a schematic perspective view showing a concrete casing process in the manufacture of the concrete rod-like member.

Then, the longitudinal reinforcing bars of the cage-like frame 4 are stretched or tensioned properly, as shown in FIG. 4. Subsequently, concrete is pneumatically cast or placed from a pump 8 into the form 5 from one end of the form 5, as shown in FIG. 5.

Figure 6:
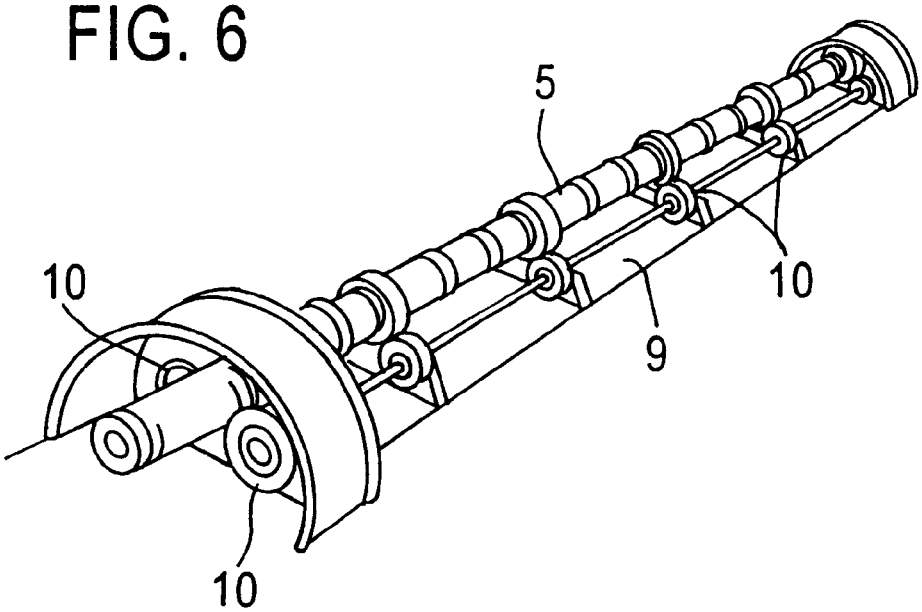
FIG. 6 is a schematic perspective view showing a centrifugal compacting process in the manufacture of the concrete rod-like member.
Figure 8A:
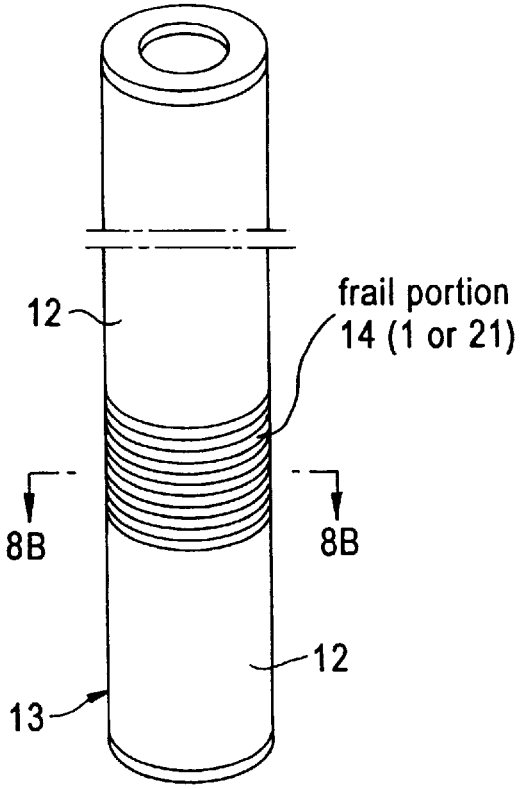
FIG. 8A is a perspective view showing one preferred form of the concrete rod-like member according to the present invention.
Figure 8B:
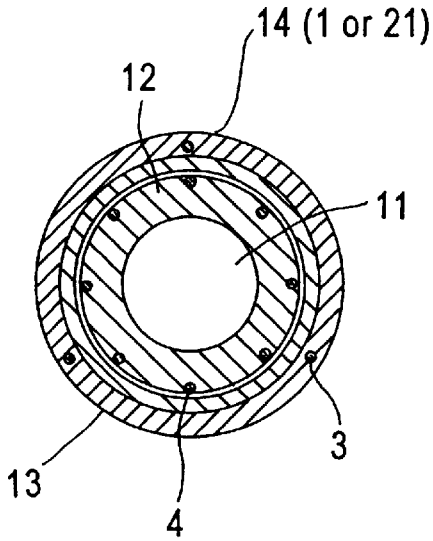
FIG. 8B is a cross-sectional view taken along line 8B—8B of FIG. 8A.
Figure 9:
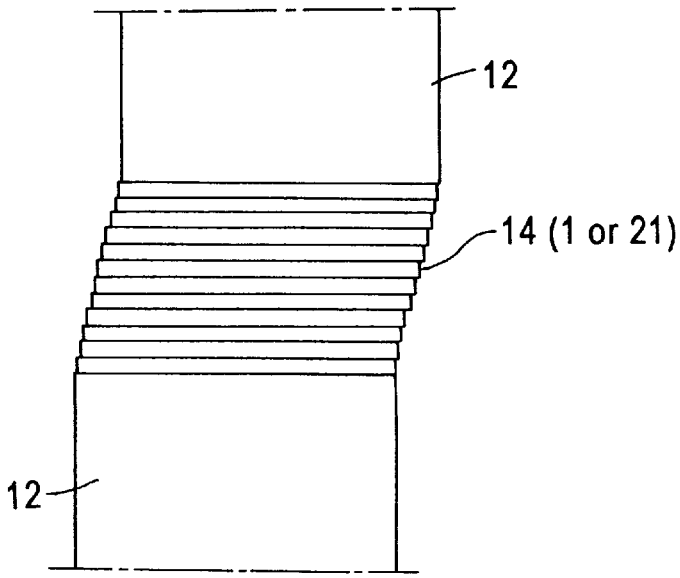
FIG. 9 is an explanatory view showing a condition in which the concrete rod-like member of the present invention is subjected to the level 2 load.
Figure 10:
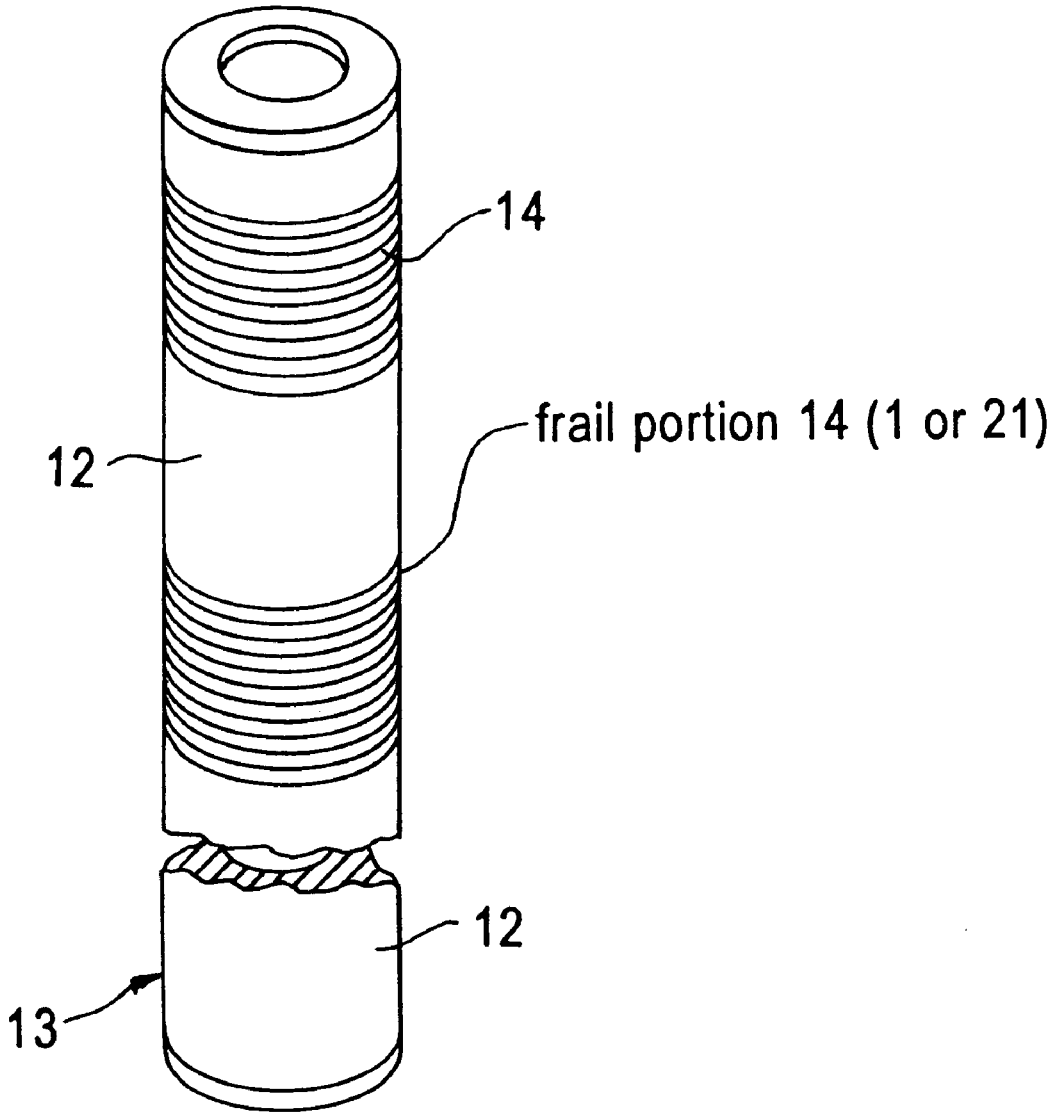
FIG. 10 a schematic perspective view showing a modified form of the concrete rod-like member according to the present invention.

After casing, the form 5 is horizontally placed on a revolving roller support 9 with two opposed rows of rollers 10, 10 of the support 9 supporting the form 5 from the opposite sides, as shown in FIG. 6. The rollers 10 are rotatably driven to rotate the form 5 about its own longitudinal axis so that the rotational speed of the form 5 gradually goes up to a high speed. Consequently, the concrete inside the form 5 is displaced radially outwardly against the inner peripheral wall of the form 5 by the action of a centrifugal force, and thus formed into a concrete rod-like member body 12 having an internal hollow portion 11 (FIGS. 8A and 8B).

Figure 7:
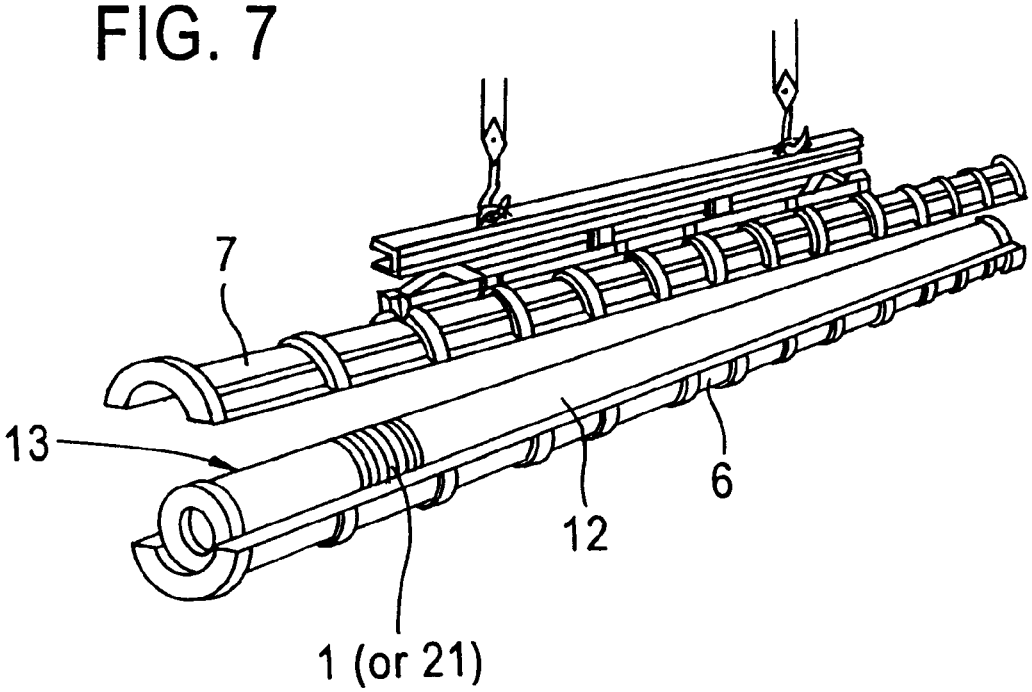
FIG. 7 is a schematic perspective view showing a form removing process in the manufacture of the concrete rod-like membered

Thereafter, the concrete is steam-cured to set the shape of the concrete rod-like body 12. Finally, the form 5 is removed, as shown in FIG. 7- A concrete rod-like member 13 having a seismic control structure, such as shown in FIGS. 8A and 813, is thus obtained.

The method of shaping the concrete rod-like member should by no means be limited to the centrifugal shaping process previously described but may include a pouring process in which concrete is poured into an annular cavity defined a form having a pair of concentrically disposed inner and outer form members. The cylindrical cage-like frame 5 formed by assembling together plural longitudinal reinforcing bars and a single spiral hoop is employed to reinforce the concrete rod-like member body 12 to such an extent that the reinforced concrete rod-like member body 12 has a strength substantially equal to the level 1 load. Thus, the size and number of the reinforcing bars as well as the size of the spiral hoop are properly determined in view of the underlying conditions for reinforcement.

In the concrete rod-like member 13 thus obtained, the piled ring assembly 1 is firmly connected with an outer peripheral surface of a longitudinal portion of the concrete rod-like member 13 such that a longitudinal central axis of the piled ring assembly 1 is coincident with a longitudinal central axis of the rod-like member 13. The longitudinal portion of the concrete rod-like member 13 to which the piled ring assembly 1 is mounted forms a frail portion 14 where the thickness of concrete is smaller than that of the rod-like member body 12. When subjected to the level 2 load, the frail portion 14 undergoes shearing deformation which may appears as a displacement ranging from zero residual deformation to failure or rupture of the piled ring assembly 1. The concrete rod-like member body 12 is kept from rupturing.

Figure 1B:
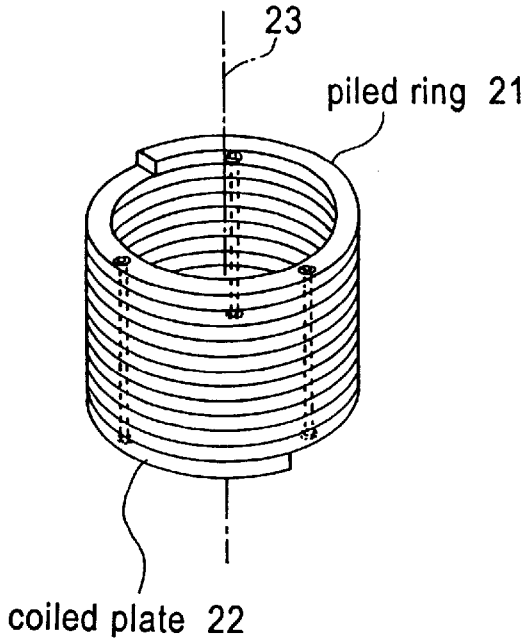
FIG. 1B is a perspective view showing another example of the piled ring assembly consisting of a helical plate used in another preferred embodiment of the concrete rod-like member with seismic control structure.

The annular plates 2 forming the piled ring assembly 1 are made of steel, aluminum alloy or the like and may have a polygonal ring-like configuration. Additionally, two or more of the frail portion 14 may be provided at intervals in the longitudinal direction of the concrete rod-like member 13. Furthermore, the piled ring assembly 1 may be replaced by a piled ring assembly 21 which, as shown in FIG. 1B, is comprised of a helically coiled plate 22 having successive convolutions or turns tied together in a direction parallel to a central axis 23 of the coiled plate 22.

As described above, the concrete rod-like member according to the present invention has a longitudinal portion forming a frail portion constituted by a piled ring assembly. Accordingly, when the rod-like member is subjected to an excessively large shearing load produced by the level 2 load, the piled ring assembly at the frail portion is displaced to absorb the shearing load, thereby preventing the concrete rod-like member body from rupturing. Even if rupturing of the concrete rod-like member body occurs, the degree of rupture can be lowered to thereby minimize secondary damage caused by the rupturing.

When the concrete rod-like member is used as a pile, it can lower acceleration of a seismic force transmitting from piles to a building or the like carried on the piles. This enables reduction of the cross-sectional area of each individual structural member of the building which may result in a building of economical design.

Furthermore, when the concrete rod-like member is used as underground piles, the frail portion is preferably disposed either in the vicinity of the pile head which is subjected to a large moment of force, or at a geological change point which may be apprehensive of liquefaction and lateral floating of ground or landslip because a passive earth pressure greater than an active earth pressure will be expected as a reaction.

Additionally, when the concrete rod-like member is used as a pole on the ground, the frail portion is preferably disposed near the ground line so that the frail portion can distort or displace to absorb an impact energy produced at collision with a car, for example. In the case of towers or chimneys, the frail portion of the concrete rod-lime member is preferably disposed near the ground line, so that unexpected energies transmitted from the ground due to earthquakes or from winds can be effectively absorbed by the frail portion.

Although the preferred embodiments of the present invention have been described, the present invention should by no means be limited to the illustrated embodiments. Rather, various changes and modifications of the present invention are possible without departing from the scope of the invention represented by the appended claims.

What is claimed is:

1. A concrete rod member having a seismic control structure, comprising:

a concrete rod member body; and a structure defining a localized area of reduced structural strength in said concrete rod member comprising: a piled ring assembly composed of a plurality of annular plates placed one upon another and secured together in a direction of piling, said piled ring assembly being set into a peripheral portion of said concrete rod member body in such a manner that the piled ring assembly is at least in part enclosed in concrete of the concrete rod member body and is incorporated into the concrete rod member body with a central axis coincident with a longitudinal central axis of said concrete rod member body and so that the piled ring assembly constitutes the seismic control structure of said concrete rod member.

2. A concrete rod member having a seismic control structure according to claim 1, wherein two or more localized areas of reduced structural strength are disposed at longitudinally spaced intervals along said rod member body.

3. A concrete rod member having a seismic control structure according to claim 1, wherein said concrete rod member body includes a generally cylindrical cage frame concentrically cast in said concrete rod member body along the length thereof so as to form a reinforcing core, and wherein said piled ring assembly surrounds and is firmly connected to the periphery of a reduced diameter portion of said concrete rod member body.

4. A concrete rod member having a seismic control structure according to claim 3, wherein two or more piled ring assemblies are disposed at longitudinally spaced intervals along said concrete rod member body.

5. A concrete rod member having a seismic control structure according to claim 1, wherein an outside diameter of the piled ring assembly is essentially the same as portions of the concrete rod member body which are located on either side thereof and which hold the piled ring assembly in a predetermined position on the concrete rod body.

6. A concrete rod member having a seismic control structure, comprising;

a concrete rod member body; and means defining a localized area of reduced structural strength comprising: a piled ring assembly comprised of a helically coiled plate having successive convolutions extending in a direction parallel to a central axis of said coiled plate, said piled ring assembly being set into the periphery of said concrete rod member body in such a manner that it is at least partially enclosed with concrete, the external surface thereof is essentially flush with an external surface of the concrete rod member body, a central axis of said piled ring assembly is coincident with a longitudinal central axis of said concrete rod member body, and so that said piled ring assembly forms the seismic control structure of said concrete rod member.

7. A concrete rod member having a seismic control structure according to claim 6, wherein two or more localized areas of reduced structural strength are disposed at longitudinally spaced intervals along said rod member body.

8. A concrete rod member having a seismic control structure according to claim 6, wherein said concrete rod member body includes a generally cylindrical cage frame concentrically cast in said concrete rod member body along the length thereof so as to form a reinforcing core, and wherein said piled ring assembly surrounds and is firmly connected to the periphery of a reduced diameter portion of said concrete rod member body.

9. A concrete rod member having a seismic control structure according to claim 6, wherein an outside diameter of the piled ring assembly is essentially the same as portions of the concrete rod member body which are located on either side thereof and which hold the piled ring assembly in a predetermined position on the concrete rod body.

10. A piled ring assembly for combination with a concrete rod member body to form a localized area of reduced structural strength along a relatively short portion of a periphery of the concrete rod member body, wherein fluid concrete is cast in a form which accommodates therewithin a cylindrical cage frame serving as a reinforcing core of the concrete, and wherein the pile ring assembly is mounted around the periphery of a longitudinal portion of the cylindrical cage frame so as to be at least partially enclosed by concrete of the concrete rod member body, said piled ring assembly comprising:

a plurality of annular plates placed one upon another and tied together in a direction of piling, said annular plates firmly engaging a predetermined peripheral portion of the concrete rod member body to establish the localized area of reduced structural strength in the predetermined portion of the concrete rod member body surrounded thereby.

11. A piled ring assembly according to claim 10, wherein the predetermined peripheral portion is a portion having a diameter which is less than the portions of the concrete rod member body which are located on either side thereof.

12. A piled ring assembly according to claim 10, wherein an outside diameter of the piled ring assembly is essentially the same as portions of the concrete rod member body which are located on either side thereof and which hold the piled ring assembly in a predetermined position on the concrete rod body.

13. A piled ring assembly in combination with a concrete rod member body which forms a localized area of reduced structural strength along the periphery of the concrete rod member body, wherein fluid concrete is cast in a form which accommodates therewithin a cylindrical cage frame serving as a reinforcing core of the concrete, and wherein the pile ring assembly is mounted around the periphery of a longitudinal portion of the cylindrical cage frame so as to be at least partially enclosed in concrete of the concrete rod member body, said piled ring assembly comprising:

a helically coiled plate having successive convolutions tied together in a direction parallel to a central axis of said coiled plate, said helically coiled plate firmly engaging a predetermined peripheral portion of the concrete rod member body so as to be essentially integral therewith and to establish the localized area of reduced structural strength in the predetermined portion of the concrete rod member body surrounded thereby.

14. A piled ring assembly according to claim 13, wherein the predetermined peripheral portion is a portion having a diameter which is less than the portions of the concrete rod member body which are located on either side thereof.

15. A piled ring assembly according to claim 13, wherein an outside diameter of the piled ring assembly is essentially the same as portions of the concrete rod member body which are located on either side thereof and which hold the piled ring assembly in a predetermined position on the concrete rod body.

* * * * *